US009126210B1

(12) United States Patent
Acharya

(10) Patent No.: US 9,126,210 B1
(45) Date of Patent: Sep. 8, 2015

(54) EFFICIENT PREMIXING FUEL-AIR NOZZLE SYSTEM

(75) Inventor: Sumanta Acharya, Baton Rouge, LA (US)

(73) Assignee: Board of Supervisors of Louisiana State University And Agricultural and Mechanical College, Baton Rouge, LA (US)

( * ) Notice: Subject to any disclaimer, the term of this patent is extended or adjusted under 35 U.S.C. 154(b) by 1123 days.

(21) Appl. No.: 12/538,935

(22) Filed: Aug. 11, 2009

Related U.S. Application Data

(60) Provisional application No. 61/088,151, filed on Aug. 12, 2008.

(51) Int. Cl.
*B05B 7/10* (2006.01)
*B05B 7/04* (2006.01)

(52) U.S. Cl.
CPC ..... *B05B 7/0416* (2013.01)

(58) Field of Classification Search
CPC ..... B05B 7/0416; B05B 7/0458; B05B 7/10
USPC ..... 239/461, 463, 468, 472, 477, 483, 489, 239/403, 405, 494
See application file for complete search history.

(56) References Cited

U.S. PATENT DOCUMENTS

| | | | | |
|---|---|---|---|---|
| 3,582,232 | A * | 6/1971 | Okapuu | 416/90 R |
| 4,383,820 | A * | 5/1983 | Camacho | 431/8 |
| 4,453,888 | A * | 6/1984 | Hovan et al. | 416/97 R |
| 4,587,809 | A * | 5/1986 | Ohmori et al. | 60/737 |
| 5,295,352 | A | 3/1994 | Beebe et al. | 60/39.06 |
| 5,408,825 | A | 4/1995 | Foss et al. | 60/39.463 |
| 5,511,375 | A * | 4/1996 | Joshi et al. | 60/39.463 |
| 5,611,196 | A | 3/1997 | Wilson | 60/39.11 |
| 5,681,144 | A * | 10/1997 | Spring et al. | 416/97 R |
| 6,663,346 | B2 * | 12/2003 | Munsell et al. | 416/97 R |
| 2010/0180599 | A1 | 7/2010 | Thomas et al. | 60/737 |

FOREIGN PATENT DOCUMENTS

WO WO 2008/131432 10/2008

OTHER PUBLICATIONS

Cheng, R.K., "Ultra-Low Emissions Low-Swirl Burner," Low-Swirl Combustion Information, Environmental Energy Technologist Division, pp. 1-6 (2008).

(Continued)

*Primary Examiner* — Davis Hwu

(57) ABSTRACT

Fuel-air premixing is the accepted technology for reducing NOx emissions from combustors and burners. In view of this complex burner-nozzle designs involving multiple swirlers have been designed and developed. I have developed a high-premixing fuel-air nozzle that involves micro-fabricated porous swirl panels with distributed fuel injection. The design and fabrication of the fuel injector has been completed, the injector assembly has been set up in a combustor test-rig, and a variety of tests have been undertaken. The tests have clearly established that compared to a traditional solid swirler with a premixing length the micro-fabricated swirl injector-assembly lowers the Lean Blowout Limit, enhances mixing and volumetric heat release, and for the same temperature levels as the solid swirler, reduces NOx levels.

1 Claim, 15 Drawing Sheets

(56) References Cited

OTHER PUBLICATIONS

GE Energy, Schenectady, NY, "Premixer Design for High Hydrogen Fuels," Cooperative Agreement No. DE-FC26-03NT41893, pp. 1-106 (2005).

Giglio, Anthony L. et al., "Distributed Micro Fuel Injection for Improved Premixing: Lean Blowout, Emissions, and Dynamics," Proceedings of ASME Turbo Expo, pp. 1-12 (2009).

Greenwood, Stuart A., "Low Emission Combustion Technology for Stationary Gas Turbine Engines," Proceedings of the 29$^{th}$ Turbomachinery Symposium, Texas A&M, Houston, TX, pp. 125-133 (2000).

Homitz, Joseph, "A Lean-Premixed Hydrogen Injector with Vane Driven Swirl for Application in Gas Turbines," thesis, pp. 1-115 (2006).

Littlejohn, David, "Fuel Effects on a Low-swirl Injector for Lean Premixed Gas Turbines," Proc. Comb. Inst., pp. 1-22 (2007).

Littlejohn, David et al., "Laboratory Investigations of Low-Swirl Injectors Operating with Syngases," J. of Eng. for Gas Turb. and Power, vol. 132, pp. 011502-1°-011502-8 (2010).

Sykes, David, "Design and Evaluation of a Lean-Premixed Hydrogen Injector with Tangential Entry in a Sector Combustor," Thesis, pp. 1-98 (2007).

Tacina, K.M., "Swirl-Venturi Lean Direct Injection Combustion Technology," Spring Tech. Meeting, Central States Section of the Combustion Institute, pp. 1-9 (2012).

Zhang, Jian et al., "A Propane-Air Micro Jet Premixer," AIChE 2007 Spring Nat'l Meeting, Houston, TX, pp. 1-14 (2007).

* cited by examiner

Close-up view of the fuel and air injection patterns

Specific hole geometry of the micro fuel injection panel

Picture of the experimental facility

Lean blowout limits for all test cases in Table 6.1-uncertainty bars apply to all CH light vs. equivalence ratio at 16.7 SCFM NOx concentration vs. equivalence ratio at 16.7 SCFM NOx concentration vs. average flame temperature at 16.7 SCFM Invention: Novel Micro Fuel-Air Premixing Nozzle

Invention: Novel Mixing Panels w/Swirl

- Distributed Fuel Injection
- High Velocity Fuel Jet
- High Co-Axial Shear Due to Opposed Injection
- Increased Turbulence
- Low Air Pressure Drop Combustion Chamber Design

Preliminary Test Results

Test Parameters

- 3 Fuel Injection Hole Density Patterns
- Effect of Bluff Body Cooling
- Effect of Distance from Dump Plane
- Equivalent Solid Swirler Performance
- Effect of Hydrogen Enrichment

EFFICIENT PREMIXING FUEL-AIR NOZZLE SYSTEM

The benefit of the filing date of provisional application Ser. No. 61/088,151, filed Aug. 12, 2008, the entire disclosure of which is hereby incorporated by reference, is claimed under 35 U.S.C. §119(e).

This application pertains to methods and devices for efficiently mixing gases, for example mixing gaseous fuel and air so that well-mixed fuel-air combinations are injected into combustors, such as furnaces, boilers, and gas turbine systems.

It is important to operate combustion units under conditions that minimize $NO_x$ emissions. Most large power generation facilities utilize land-based gas turbine systems, which use natural gas, usually premixed with air, as fuel. In typical combustion chambers, as the ratio of fuel to air approaches stoichiometric proportions, emissions of $NO_x$ tend to increase. As the ratio of fuel to air is decreased, the combustion temperature is decreased, resulting in a lowering of $NO_x$ emissions. However, CO emissions increase with reduced temperatures, and at some point the fuel/air ratio decreases to a ratio at which combustion is no longer supported, often characterized as the "lean blow out" limit ("LBO"). In some applications, emissions of $NO_x$ have been minimized by running with fuel to air ratios close to the LBO at about 0.5:1.0.

Performance of low polluting, lean premixed gas turbine systems may be improved by injection of well-mixed fuel-air mixtures. Swirl, generated by passing a combustion mixture over angled fins prior to injection into a combustion chamber, appears to increase turbulence to improve mixing of air-fuel combinations, and to enhance maintaining a flame. The most advanced current technology typically requires the use of a series of two or three swirlers with accompanying built-in fuel passages, which results in large, complex, expensive systems. However, even when using a series of swirlers, available technology typically only decreases $NO_x$ concentration to about 10 ppm in combustion chambers.

See Kelly, K. W., Acharya, S., Zhang, J., and Becnel, C., "A Propane-Air Jet Premixer", AIChE 2007 Spring National Meeting, Houston, Tex. April 2007.

There is an unfilled need for a method and a device that will pre-mix fuel and air so that $NO_x$ concentrations generated during combustion are minimized when operated under lean conditions, wherein the size and complexity of the device is minimized.

I have developed a method and a device comprising a compact nozzle system comprising multi-channel counter-injection swirlers for injecting premixed gas and air that minimizes $NO_x$ emissions. Said nozzle systems enhance mixing of the gases and heat released from the process at low LBO.

In one embodiment of the multi-swirler blade nozzle system, a multiplicity of fuel injection ports was located on the upstream face of each swirler blade. Fuel was injected into an air stream in the direction opposite to the flow of the air stream. The fuel/air mixture was then passed by the swirlers. Mixing of the fuel with the air appears to have occurred in a very small volume immediately prior to swirling. Because of the increased efficiency of mixing resulting from this novel nozzle system, fewer swirler assemblies for enhancing the mixing were required, resulting in small, lightweight, low cost systems.

Efficiencies of combustion chambers, such as gas turbines, furnaces, and boilers, may benefit from the nozzle disclosed herein.

SUPPORTING DATA

Figure 1:
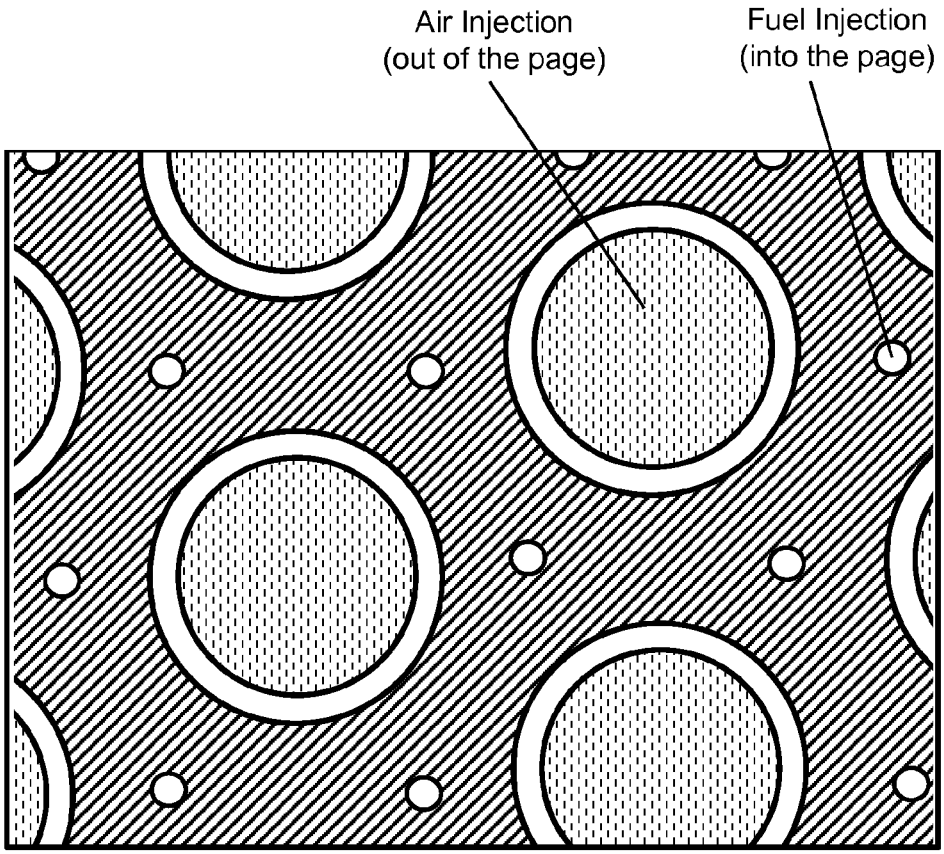
FIG. 1 depicts a close-up view of the fuel and air injection patterns for one embodiment of the invention.

The current study has developed a novel fuel swirler for lean premixed combustion, a typical operating mode for land based gas turbines. Incentives for enhancing the air-fuel mixture include a direct reduction in NOx emissions and a combustion environment less prone to instabilities and flame extinction. Current combustors can operate with NOx emissions near 10 ppm but new environmental regulations in certain states may require emissions levels below 5 ppm. Past research in air-fuel mixing has shown that the introduction of swirl affects the fluid dynamics in such a way that it greatly enhances the uniformity of the mixture by adding shear and increasing turbulence. Combining fluid swirl with strategically placed fuel injection points, high levels of shear and turbulence can be achieved to enhance the quality of the mixture bringing it closer to a perfectly homogeneous gaseous mixture. Using micro manufacturing techniques, it is possible to design and fabricate a semi-porous swirler with distributed fuel injection across the swirl vanes. This type of combustor design combines the effects of fluid swirl, distributed fuel injection, increased turbulence intensity, and high air-fuel shearing rates to enhance the air-fuel mixing in an attempt to achieve a perfect molecular mixture. Such a micro-fuel-injection swirler (MFIS) has been designed, built and a lab-scale combustor rig has been set up and tested. The preliminary tests have been conducted, and currently detailed tests are ongoing.

The swirl panels were fabricated by machining an aluminum plate to represent the negative mold of the final product. The plate was then nickel electroplated to a desired thickness (≈75 μm) and the ends of the plate were cut off to expose the aluminum. The plate was then set in a caustic solution which dissolved the aluminum leaving a nickel shell. Small holes (≈0.006 in.) were micro-drilled on one side of the plate to allow for the fuel injection. The panels were then attached to a center manifold through a vacuum nickel brazing process. A combustion chamber has been designed and fabrication was completed so that first-stage testing could be undertaken. The test chamber feeds fuel through a center tube attached to the mixer which is positioned immediately before the dump plane where the flame will rest. It is equipped with a quartz tube used for flame visualization and testing of flow field data in non-reacting and reacting flow. Temperature measurements in the flame are obtained using a high temperature thermocouple rake to resolve the radial temperature profile at varying axial locations. Pressure ports are located along the combustor to monitor acoustic behavior and an emissions analyzer is placed at the exit nozzle to measure NOx species concentration in the exhaust gases.

We have tested the performance of the MFIS injector. These tests have primarily been on overall performance metrics such as Lean Blow Out (LBO) Limit, heat release (based on a measure of the CH-radicals), NO measurements, and combustion dynamics (based on pressure measurements). More detailed measurements are currently ongoing. The benchmark test for comparison is a standard solid swirler with fuel injection occurring far upstream near the air inlet to allow for considerable premixing length.

The LBO limit is the minimum equivalence ratio at which the combustor can sustain the flame without blowing it out. This metric is important because it defines the range of flammability conditions for the combustor, and how lean the combustor can be operated. Generally, the leaner the combustor operation, lower is the NO emissions. The heat release, over a specific combustor volume near the dump plane, is a measure of the mixing between the fuel and air. The NO measurements are a critical measure for land based-gas turbine operation. Current targets are directed towards lower than 5 ppm under stable operation near the LBO. Finally, combustion dynamics is a key detriment for land-based gas turbines operating close to the LBO. Combustion dynamics are characterized by strong pressure oscillations and can lead to adverse combustor performance including structural fatigue. There has been a lot of work related to suppression of combustion dynamics, but it is better to begin with a fuel injector that minimizes or eliminates the region of strong combustion dynamics altogether.

In the discussion below, we will focus on two key issues: the design and fabrication of the fuel injector, and some key results that clearly demonstrate the improved performance of the injector.

MFIS Injector Design:

In this configuration, a single swirler is employed in the same manner as a traditional swirler except that the swirl blades are replaced with fuel injection plates. In this design, the area over which fuel is injected is greatly enlarged allowing for a much finer fuel distribution. The fuel is injected perpendicular to the plane of the blade which is at some angle depending on the desired degree of swirl. Though it is at an angle, the velocity of the fuel jets opposes the oncoming air stream. As the oncoming flow enters the swirler, some of the fluid is swirled by the vanes while some passes through the panel. The fluid being swirled encounters the fuel in cross flow, and the mixed air stream passes through the panel. This induces shear layers in the flow which enhance mixing and provide flame stability. The mixture exiting the thru holes on each panel forms eddies, which have high turbulence intensity. These eddies penetrate the large scale swirling flow structure which energizes the turbulence intensity levels. An illustration of the fuel and air-injection pattern (close-up view) is shown in FIG. 1. A full 3D solid model of the micro fuel injection swirler (MFIS) was developed using Solid works 3D parametric modeling software and is shown (with modifications) in FIG. 2. See A. Giglio, *A High-premixing Swirl-Nozzle for Lean Premixed Combustion*, M.S. Thesis, Louisiana State University (Baton Rouge, Louisiana 2008).

Figure 2:
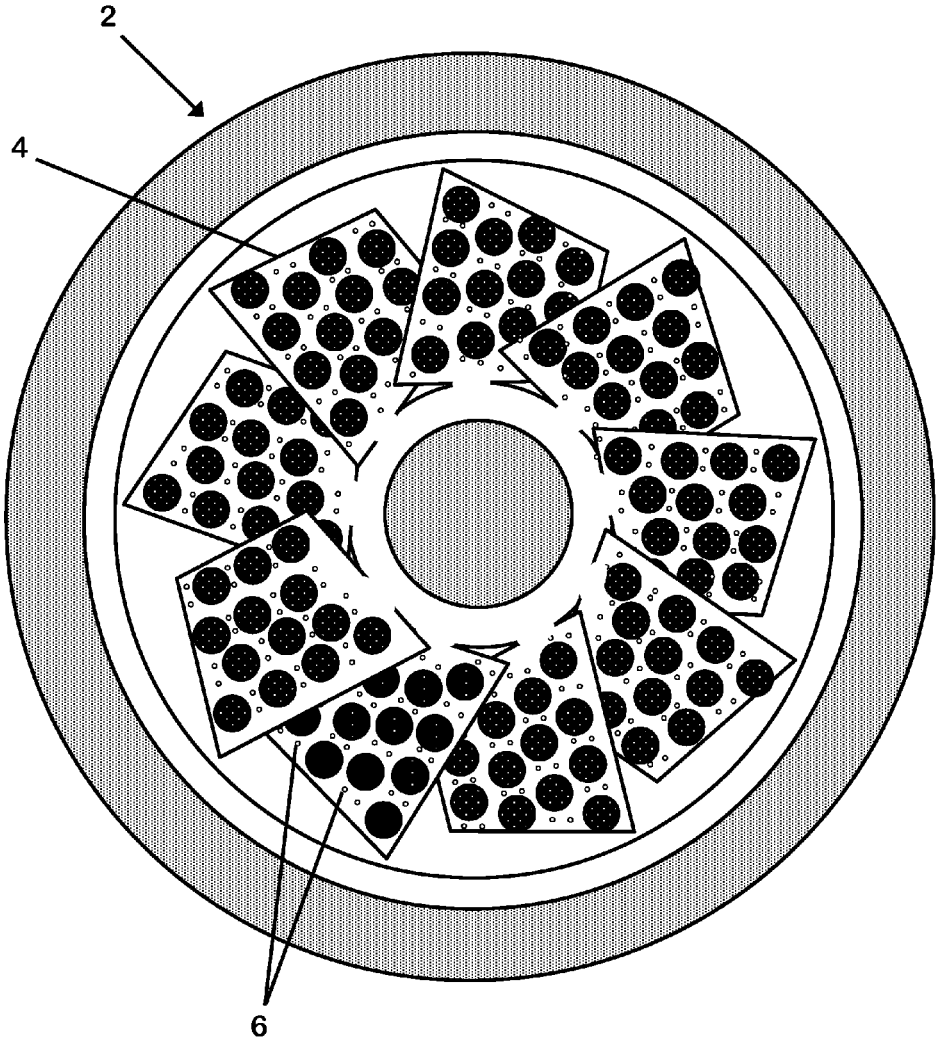
FIG. 2 depicts a micro fuel injection swirler for one embodiment of the invention.

Referring to FIG. 2, one embodiment of the invention comprises an apparatus 2 for the highly efficient mixing of gaseous fuel and air prior to combustion; said apparatus 2 comprising a swirler having a plurality of blades 4, each blade 4 having internal conduits (not shown) that direct fuel through the interior of the blade 4 to through holes 6 on the surface of the blade 4; so that, in operation, fuel is injected into the air stream directly from the surface of the blades 4 in a direction that is perpendicular or approximately perpendicular to the surface of the blades 4, and that is opposite or approximately opposite in direction to the oncoming air stream; as air enters the swirler, at least some of the air is swirled by the blades 4; the swirled air encounters injected fuel in a cross-flow direction, inducing eddies of air and fuel that enhance mixing and that enhance flame stability when the air-fuel mixture is burned.

In order to fabricate the MFIS, the micro fuel injection panels had to be manufactured separately and then joined with the main body to create an 8 blade pattern shown in FIG. 2. The manufacturing procedure for the panels is outlined below.

1. The base mandrel is cast to size with aluminum 6061 material.

2. The primary features (i.e. thru holes and edge radii) are machined into regions of the mandrel where panels will be cut away later.

3. A nickel coating is applied to all surfaces of the mandrel via the electroplating process.

4. The fuel injection holes are drilled into the face of the mandrel at desired locations for each panel.

5. Individual panels are separated from the base mandrel exposing the internal aluminum.

6. The panels are dipped in a caustic solution to dissolve and remove all original aluminum material leaving an internal cavity for fuel passage.

Figure 3:
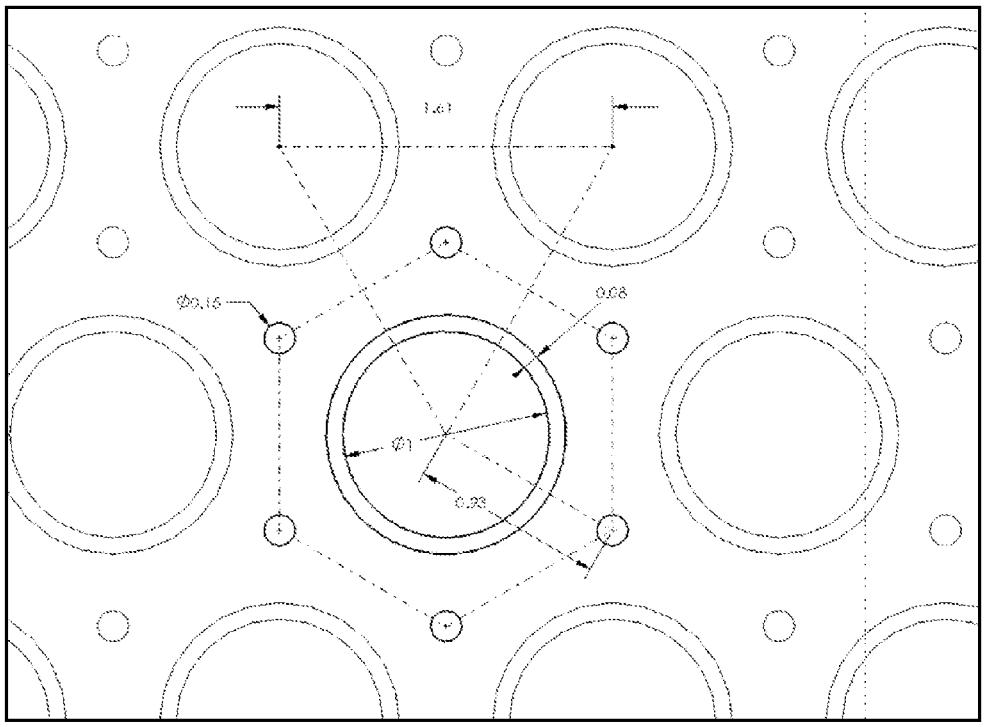
FIG. 3 depicts the hole geometry of a micro fuel injection panel for one embodiment of the invention.
Figure 4:
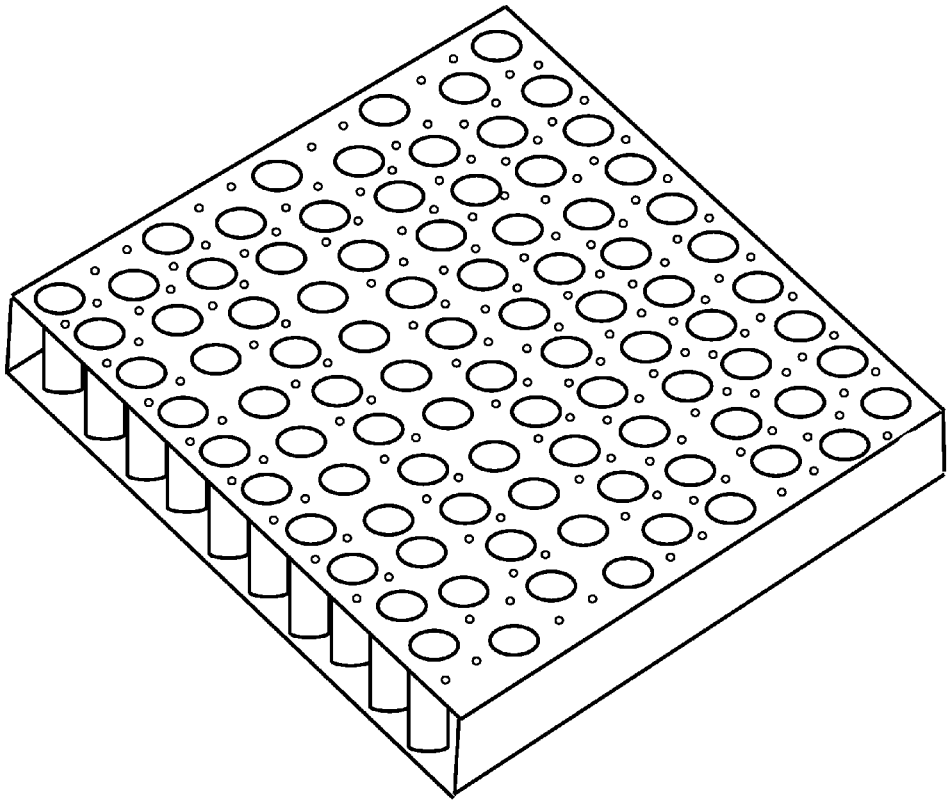
FIG. 4 depicts a conceptual solid works model of the micro fuel injection panel (representing the swirler blade) for one embodiment of the invention.

The dimensions of the features on the panel were chosen based on the scale of the premixer as a whole and the geometry constraints of the panel. FIG. 3 shows the specific hole geometry. A conceptual model of the micro fuel injection panel is shown in FIG. 4. The specific geometry (i.e. fuel injection hole diameter and spacing) was chosen to achieve a high momentum ratio of fuel to air which affects the fuel jet penetration distance and plume spreading. The momentum ratio is the ratio of the fuel momentum to the air momentum. The momentum of a gas stream is the product of its mass flow rate and velocity. Higher momentum ratios lead to more effective mixing due to an increase in the jet penetration distance. See A. Giglio (2008).

The through hole size and spacing were selected to provide high porosity while allowing sufficient internal space for the fuel to flow through. A summary of the injection patterns is given in Table 1 where V is velocity, M is momentum ratio and the subscripts F and A refer to fuel and air.

TABLE 3.1

| Fuel injection pattern parameters at air flow rate of 32 SCFM and Φ = 0.75 | | | |
|---|---|---|---|
| Pattern | Holes/Panel | $V_F$ (m/s) | $M_F/M_A$ |
| Coarse | 66 | 128 | 0.434 |
| Medium | 132 | 64 | 0.217 |
| Fine | 264 | 32 | 0.108 |

The Micro Fuel Injection Swirler was fabricated by joining the fuel injection panels to the center body and outer ring as shown in FIG. 2. The function of the center body is to provide a central fuel manifold for the circular array of micro fuel injection panels. The center body is also part of the bluff body design used to stabilize the flame. Fuel travels through the center feed assembly and enters the internal cavity of the center body where it then enters each of the 8 fuel injection panels. The opposite end of the fuel injection panel must terminate at the outer ring but since the end is open, a seal must be formed at the joint. Also, the outer ring has a circular profile while the end of the panel is rectangular so the two cannot simply be butted together. In order to join the panels with the center body and outer ring, a brazing procedure was developed. The procedure provides a simple approach to assemble the micro fuel injection swirler. See A. Giglio (2008).

Performance Metrics Data and Analysis:

The experimental data was taken for a number of test cases which are summarized in Table 2. The notation used for both the solid swirler/upstream fuel injection and the MFIS injection is also indicated. As an example the MM-S-L-0.5 notation implies a MFIS case (MM) with a straight open exit (S), fuel injected locally at the swirler location (L) and with the swirler located 0.5 inch upstream of the dump plane (0.5). The solid swirler cases are denoted by SS, constricted nozzle exit denoted by N, and upstream injection denoted by U. The swirler is located either at 0.5 inch from the dump plane or 1.5 inch from the dump plane.

Figure 5:
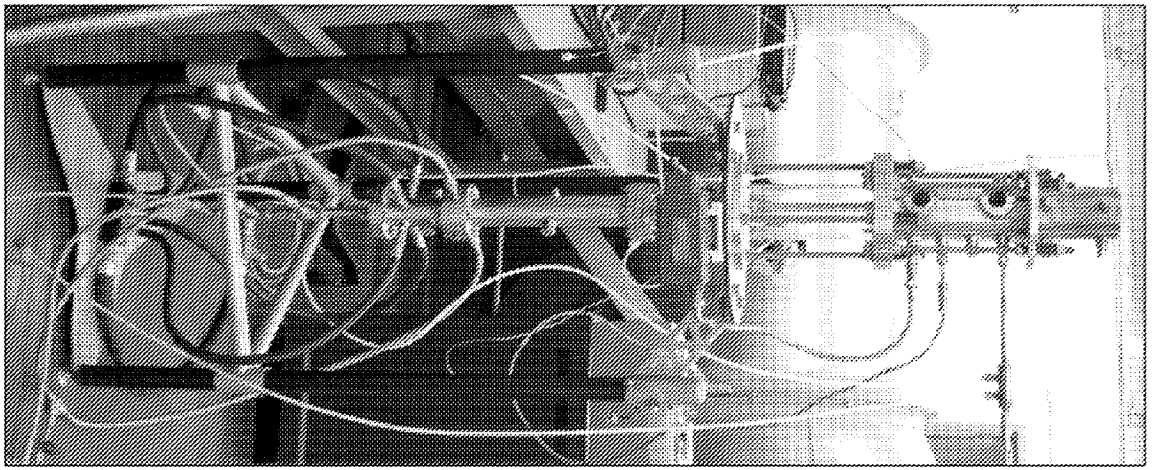
FIG. 5 depicts a photograph of a prototype experimental embodiment.

The experimental test rig is shown in FIG. 5. The major design issues in fabricating the combustion chamber were based on measuring fundamental combustion parameters as well as obtaining visual diagnostic data from particle image velocimetry (PIV), CH chemiluminescence, and planar laser induced fluorescence of the OH radical (OH-PLIF).

TABLE 2

| Experimental test cases | | | | | |
|---|---|---|---|---|---|
| Case | Mixer Type | Exit Condition | Injection Location (mixing length) | Swirler Location | Notation |
| 1 | MFIS | Straight | Local (0.5) | 0.5 | MM-S-L-0.5 |
| 2 | MFIS | Straight | Local (1.5) | 1.5 | MM-S-L-1.5 |
| 3 | MFIS | Nozzle | Local (0.5) | 0.5 | MM-N-L-0.5 |
| 4 | Solid Swirler | Straight | Upstream (20) | 0.5 | SS-S-U-0.5 |
| 5 | Solid Swirler | Straight | Local (1.5) | 0.5 | SS-S-L-0.5 |
| 6 | Solid Swirler | Nozzle | Upstream (20) | 0.5 | SS-N-U-0.5 |

See A. Giglio (2008).

In order to provide a stabilization mechanism for the flame, the testing apparatus uses a sudden expansion geometry (step) at the inlet-combustor junction. Also, due to the inherent geometry of the MFIS as well as most swirlers found in industry, a bluff body is present at the center of the combustor-inlet junction. Due to the bluff body wake and the swirl induced by the MFIS, shear layers are formed behind the bluff body and in the downstream flow. As a result, vortex breakdown can occur and a central toroidal recirculation zone will form. The recirculation of hot products into the oncoming reactants in combination with the shear layers behind the bluff body will cause the flame to stabilize and attach to the rim of the bluff body. The shear layers provide a region of low velocity where the local flame speed can match the speed of the oncoming reactants. A similar effect occurs on the outer rim of the inlet-combustor junction where corner recirculation zones may be present due to confinement and the sudden expansion geometry of the junction. See A. Giglio (2008).

The combustor is divided into five modules: (1) center feed assembly, (2) upstream chamber, (3) downstream chamber, (4) fluid accessories system, and (5) test stand. The center feed assembly delivers fuel and coolant to the MFIS. The upstream chamber provides a means to deliver and condition combustion air to the MFIS or other mixing devices. Flow in the upstream chamber is considered nonreacting since no combustion reactions are present. The downstream chamber forms the confining region for the reacting flow and is typically referred to as the combustion chamber. The point at which the upstream chamber meets the downstream chamber is commonly referred to as the combustor-inlet junction or dump plane in this case. The fluid accessories system refers to all piping components used to deliver fluids to the testing apparatus. Components include tubing, piping, valves, manifolds, and fittings. Fluids include fuel (methane or hydrogen), air, and water used for cooling various components. The test stand provides a means to mount the test apparatus and associated hardware in a configuration that provides stability, rigidity and easy access when performing tests. While the design of the entire test apparatus is driven by the scale and geometry of the MFIS, all of the modules and their components must be integrated together in a complete assembly which is shown in FIG. 5. See A. Giglio (2008).

Figure 6:
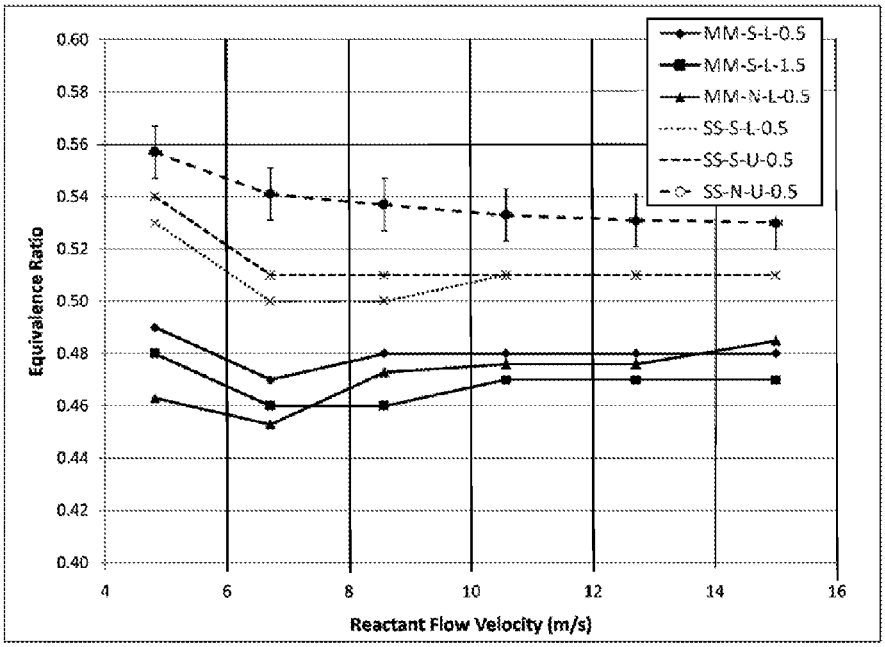
FIG. 6 depicts measurements of lean blowout limits for several experimental test cases.

The lean blowout limits for each test case were obtained by igniting the air-fuel mixture at Φ=0.75, allowing the combustion chamber temperature to reach steady state, and then slowly decreasing the fuel flow-rate until the flame was extinguished and no longer visible. This was done over the range of flow-rates given in Table 2. Lower lean blowout limits indicate well mixed reactants as well as a stable flame at lean conditions. Factors affecting flame stability include hot product recirculation, degree of swirl, turbulence intensity, and molecular mixing of the fuel and air. The results of the lean blowout test are shown in FIG. 6. The uncertainty bars shown for the SS-N-U-0.5 case apply to all data points in the figure. The desired result is a low lean blowout limit. This allows the combustor to operate at leaner conditions, hence lowering the global reaction rate through a reduction in flame temperature, resulting in a reduction of NOx emissions. FIG. 6 indicates that the MFIS was able to operate at leaner limits, which is attributed to better mixing and increased turbulence as a result of the swirler-panel turbulence grid and the proximity of the micro fuel jet mixing region to the primary combustion zone. Increased turbulence produces fine scale wrinkling of the turbulent flame front leading to an increase in the turbulent flame speed. The increase in flame speed enables the flame to remain attached to the dump plane at leaner limits due to its increased resistance to flame strain. In the MM-S-L-1.5 case, the MFIS was positioned 1.5 inches from the dump plane giving it an additional 1 inch of mixing length as compared to the MM-S-L-0.5. A slight improvement in the lean blowout out was observed but appeared to be within the uncertainty limits of the measurements. The lean blowout limits did not change significantly when the nozzle exit condition was used with the MFIS, (MM-N-L-0.5). For the MFIS, the nozzle exit condition caused nominal flame instability near stoichiometric conditions but as the equivalence ratio approached the lean limit, the flame appeared more stable and a significant reduction in combustion instability was observed. The SS-S-U-0.5 benchmark case produced reasonably low lean blowout limits ($\Phi$=0.51) but generally exhibited extinction at an equivalence ratio 0.03 higher than the lean limit of the MFIS cases. The SS-S-L-0.5 case produced similar blowout limits as compared to the SS-S-U-0.5 case. Since the mixing length for this case is considerably shorter than that for the SS-S-U-0.5 case, the expected result was a higher lean blowout limit. Due to the reasonable number of fuel injection ports (18) and the implementation of swirl at the dump plane, this case could be experiencing a higher than expected level of mixing. It should be noted, however, that the flame behavior for this case was very intermittent and appeared to be less stable than the SS-S-U-0.5 case or the MFIS cases, which would indicate a less uniform mixture. One very plausible reason for a relatively low extinction limit in this case could be the presence of fuel rich regions near the dump plane which help to keep the flame attached to the dump plane. The lean limits for the SS-N-U-0.5 case were on average, 0.02 higher than the other two SS cases employing the straight exit condition. The higher extinction limits for this case are attributed to the severe flame instabilities as indicated by the pressure and heat release data and by visual observation of the flame. Theoretically, the lean flammability limit of a methane/air flame is 0.46 with reactants at standard temperature and pressure. The results presented here demonstrate the capability of the MFIS to approach this limit with a considerably shorter mixing length as compared to the cases with a solid swirler and longer premixing distances. See A. Giglio (2008).

Figure 7:
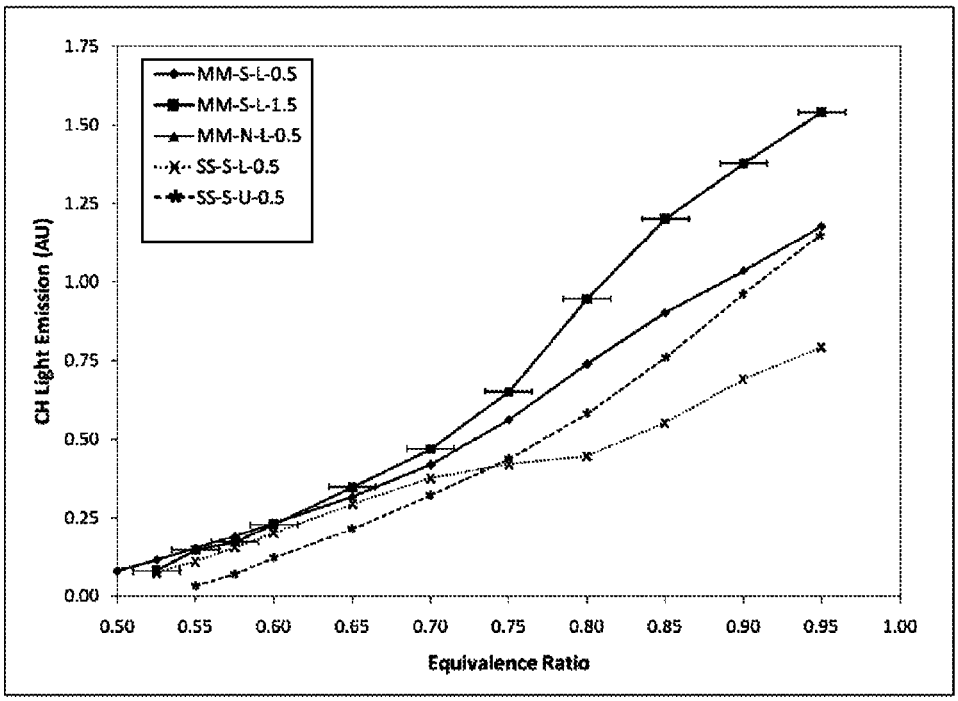
FIG. 7 depicts CH light vs. equivalence ratio at 16.7 SCFM for several experimental test cases.

The heat release results in FIG. 7 (obtained with a field-of-view CH-filtered photodiode) show that the mean CH light emitted by the SS-S-L-0.5 case was the lowest in comparison with the other cases, especially near stoichiometric. This is expected since it is presumed to be the least mixed case. Observation of the flame luminosity images at 26.3 SCFM indicates that the flame for the SS-S-L-0.5 case is indeed stretched more so than the other cases which would complement the CH light results presented in FIG. 7. See A. Giglio (2008).

The MFIS cases produced higher CH levels than the SS-S-L-0.5 case and this difference is larger at higher equivalence ratios. This result is also supported by observing the flame luminosity images which show that there is a more intense reaction at the dump plane for the MFIS cases. There seems to be a significant improvement in the CH levels achieved by moving the MFIS upstream as indicated by differences between the CH light results for the two MFIS cases.

Observation of the flame luminosity images show that the flame front near the dump plane for the MM-S-L-0.5 case was less luminous indicating less reaction in that region compared to the MM-S-L-1.5 case. In light of this observation, since the photodiode is positioned to view the region immediately downstream of the dump plane, the mean CH light measured would expectedly be lower for the MM-S-L-0.5 case in comparison to the MM-S-L-1.5 case. The well mixed benchmark case, SS-S-U-0.5 produced relatively higher CH light values than the SS-S-L-0.5 but was consistently lower than the MM-S-L-1.5 case. This could be attributed to its slightly longer flame, in comparison, as evidenced by the flame luminosity images. At ultra lean conditions, differences in CH light emission between each case become very small rendering the measurement less useful as an indication of combustion intensity. In general, the flame images show that the MFIS provided efficient mixing over a very minimal premixing distance based on the relatively short flame height, intense reaction zone indicated by CH light, and observed stable flame holding characteristics. See A. Giglio (2008).

NOx emissions are fundamentally controlled by temperature. At high temperatures (T>1800 K), thermal NOx is the predominant formation mechanism occurring in the post flame region. Below 1800 K, prompt NOx is formed in the primary reaction zone and precedes slower rates of thermal NOx formation. The opportunity for prompt NOx formation in the flame region is dependent on the availability of the hydrocarbon radical (CH) and the radicals H, O, and OH. The concentration of these radicals is increased when the reaction zone is intense and compact. NOx formation is globally affected by flame temperature so a reduction in flame temperature has the potential to reduce NOx regardless of the formation route. Another factor affecting NOx formation is air/fuel nonuniformity. At ultra lean conditions, air/fuel nonuniformity increases NOx emissions while at conditions near stoichiometric, air/fuel nonuniformity tends to decrease NOx emissions. See A. Giglio (2008).

In these experiments, NOx was measured along the combustor axis at a position 18 inches downstream of the dump plane. Measurements along the radial direction indicated that NOx concentrations 18 inches downstream were constant along the radial direction. Based on this result, NOx measured at the combustor axis was taken as representative of the average NOx concentration in that plane of the combustion chamber. The thermocouple rake measured the temperature at a distance of ⅓R, ⅔R, and R away from the combustion chamber wall, where R is the radius of the combustion chamber. These temperatures were averaged to obtain the average flame temperature in the combustion chamber and are used to provide an indication of the potential for NOx formation. Averaging the temperatures along the radial direction is a reasonable approximation to the overall flame temperature assuming that the flame temperature profile is parabolic by nature along the radial direction. Since the temperatures were measured 10 inches downstream of the dump plane, the flame temperature profile was indeed smooth and parabolic, ascertaining the stated assumption concerning the validity of an average temperature. See A. Giglio (2008).

Figure 8:
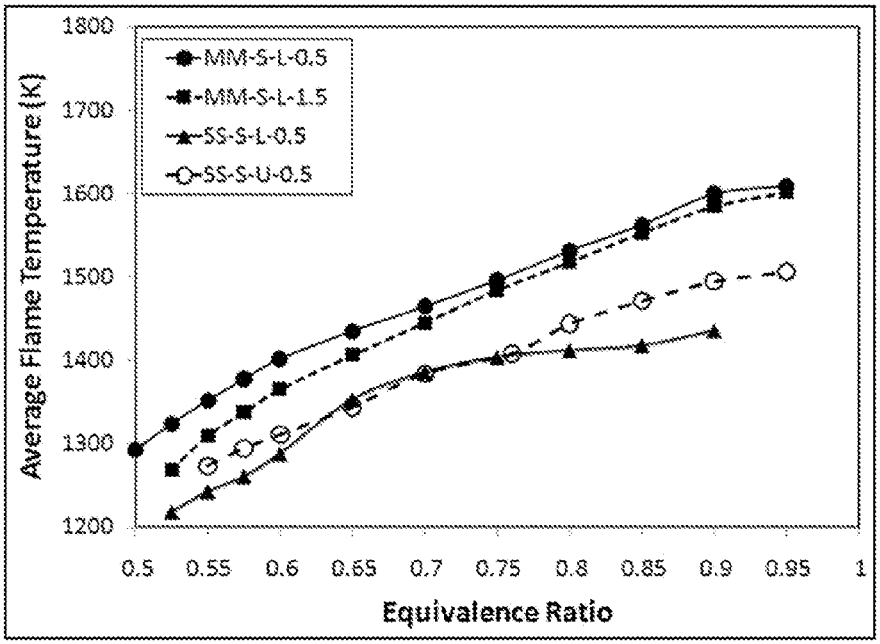
FIG. 8 depicts average flame temperature vs. equivalence ratio at 16.7 SCFM for several experimental test cases.

Results shown in FIG. 8 indicate that the MFIS produced higher average flame temperatures than the baseline cases which employ the solid swirler. The straight exit case with the lowest average temperatures at all flow rates was the SS-S-L-0.5 case which is consistent with the assumption that it had the least effective mixing. In general, the results for the two MFIS cases show comparable temperature values. Differences in flame temperature between the SS cases were minimal with the SS-S-U-0.5 generally showing slightly higher temperatures than the SS-S-L-0.5 case. Lower flame temperatures could be an indication of incomplete combustion particularly due to the slow oxidation of CO to $CO_2$ as a result of less effective mixing. See A. Giglio (2008).

It should also be noted that while the CH data (FIG. 7) and the temperature data (FIG. 8) show qualitative agreement as is expected (e.g., the MM cases show higher temperature than the SS cases), differences in magnitudes and trends are also related to the size of the flame (relative to the viewing window of the CH sensor) and the location of the temperature rake and the relative height of the flame.

Figure 9:
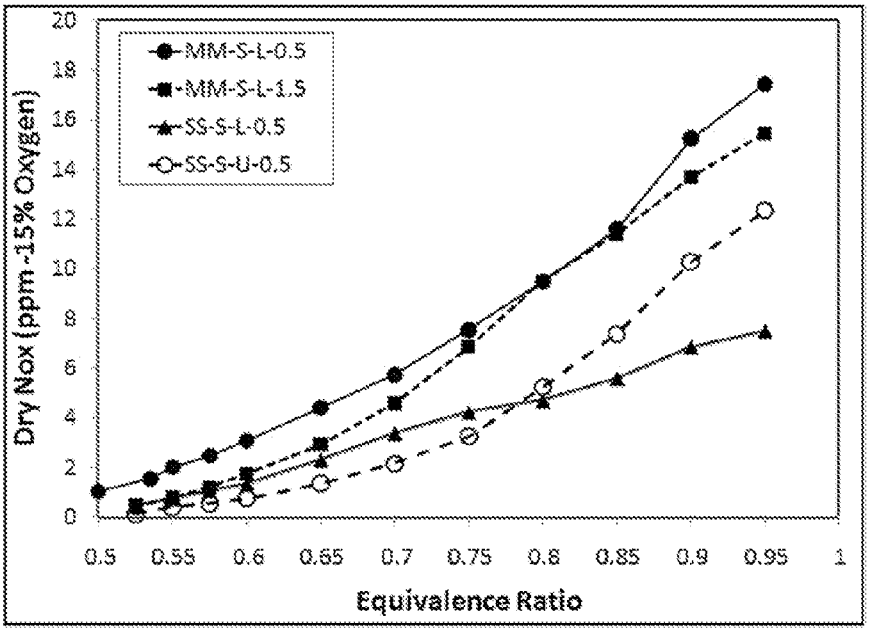
FIG. 9 depicts NOx concentration vs. equivalence ratio at 16.7 SCFM for several experimental test cases.

FIG. 9 gives the NOx concentrations as a function of equivalence ratio for the air flow rate of 16.7 SCFM and show that the MM-S-L-0.5 produced slightly higher NOx concentrations at a given equivalence ratio as compared to the MM-S-L-1.5. This is consistent with FIG. 8 which shows that the average flame temperature was slightly higher for the MM-S-

L-0.5. The SS-S-U-0.5 case generally produced the lowest NOx emissions at the lower equivalence ratio and showed lower flame temperatures than the MM case. The SS-S-L-0.5 case produced less NOx than the MFIS cases but produced temperatures lower than all other cases. The SS-S-U-0.5 case showed significantly lower NOx levels, which is in agreement with the measured flame temperatures. See A. Giglio (2008).

Figure 10:
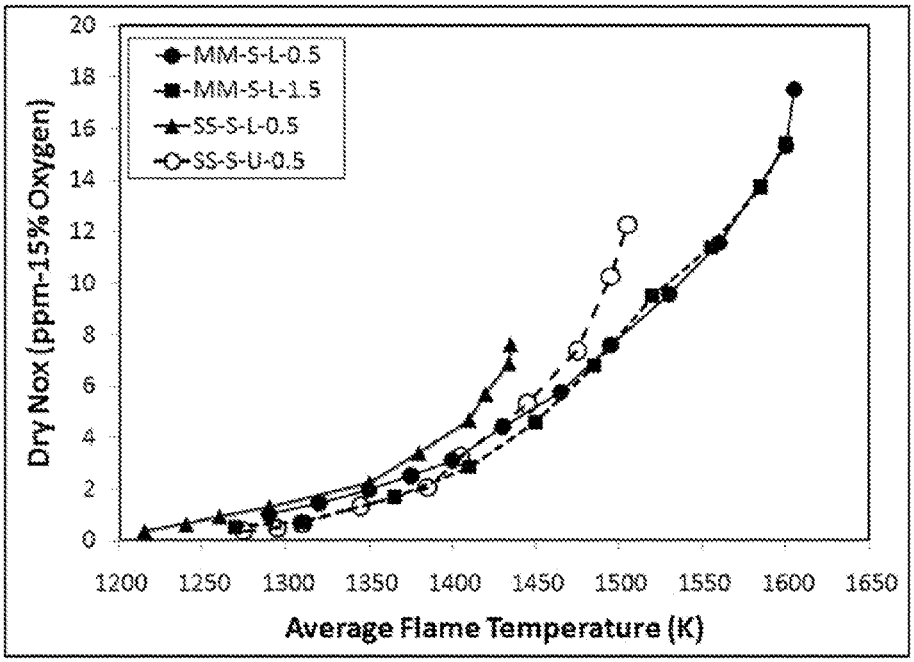
FIG. 10 depicts NOx concentration vs. average flame temperature at 16.7 SCFM for several experimental test cases.

In examining NOx emissions, a key metric is the amount of NOx produced at the same average/adiabatic temperature. Lower NOx at the same average temperature implies improved performance. FIG. 10 shows the NOx values plotted as a function of the average temperature for the various cases. The results show that NOx emissions are higher for a measured average flame temperature for the SS-S-L-0.5 case which is the anticipated result due to imperfect mixing and local regions of higher stoichiometry. The MM-S-L-0.5 produced lower NOx at a given flame temperature compared to the SS-S-L-0.5 case. The MM-S-L-1.5 showed a further decrease in NOx concentration with respect to flame temperature. The SS-S-U-0.5 case produced more NOx for a given flame temperature than the MFIS cases at the flow rate of 16.7 SCFM. See A. Giglio (2008).

Thus, it can be clearly concluded that for the same flame temperature, the MFIS injector produces lower NOx than the solid swirler. For example at 1500K, the SS-S-U-0.5 produces about 12 ppm while the MFIS injector produces about half as much as NOx.

Combustion dynamics is a major problem for land-based gas turbines. It leads to large pressure and heat release oscillations, eventually leading to structural fatigue and poor performance of the gas turbine. The oscillations occur due to a coupling between the acoustics of the combustor and the heat release fluctuations. To control these oscillations, the combustion dynamics should be so designed that the heat release fluctuations are broad-band, low amplitude, and do not couple with the inherent acoustics of the system. Although a number of designs have focused on active control by attempting to alter the heat release behavior if the dynamics begin to exhibit coupling, a better strategy is to design a fuel-air injection system that exhibits stable low-amplitude behavior over a wide operating range and does not show large amplitude dynamics.

Figure 11A:
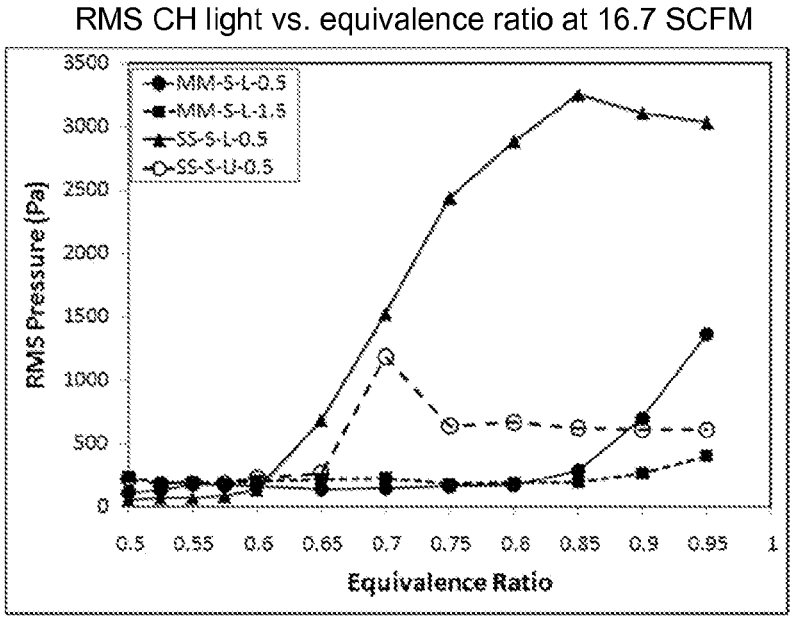
FIGS. 11A and 11B depict RMS pressure and CH light vs. equivalence ratio at 16.7 SCFM for several experimental test cases.
Figure 11B:
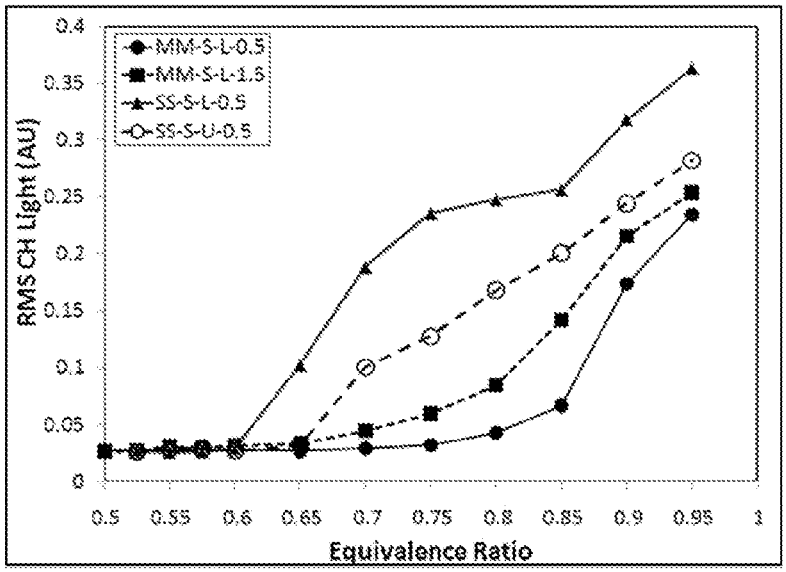
Figure 12:
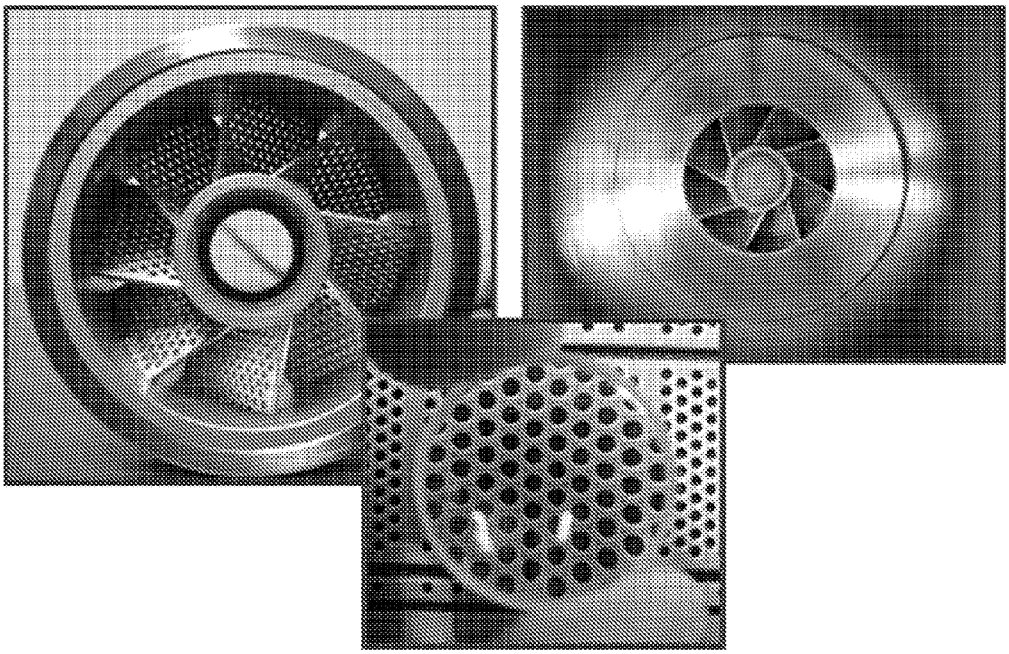
FIG. 12 depicts an embodiment of a prototype micro fuel-air premixing nozzle.
Figure 13:
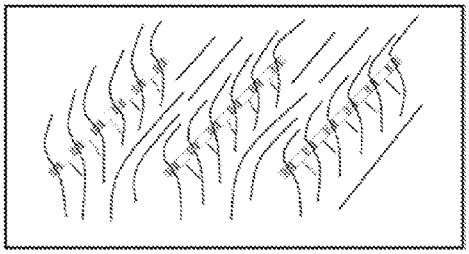
FIG. 13 depicts an embodiment of novel mixing panels with swirl for use in the present invention.
Figure 13:
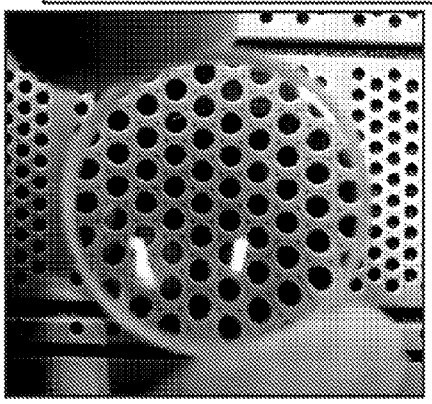
Figure 13:
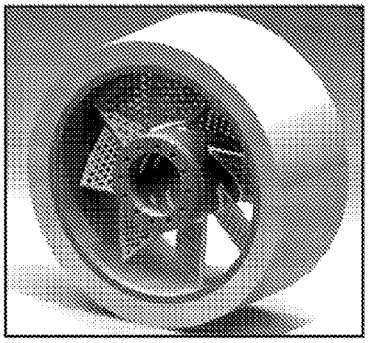
Figure 14:
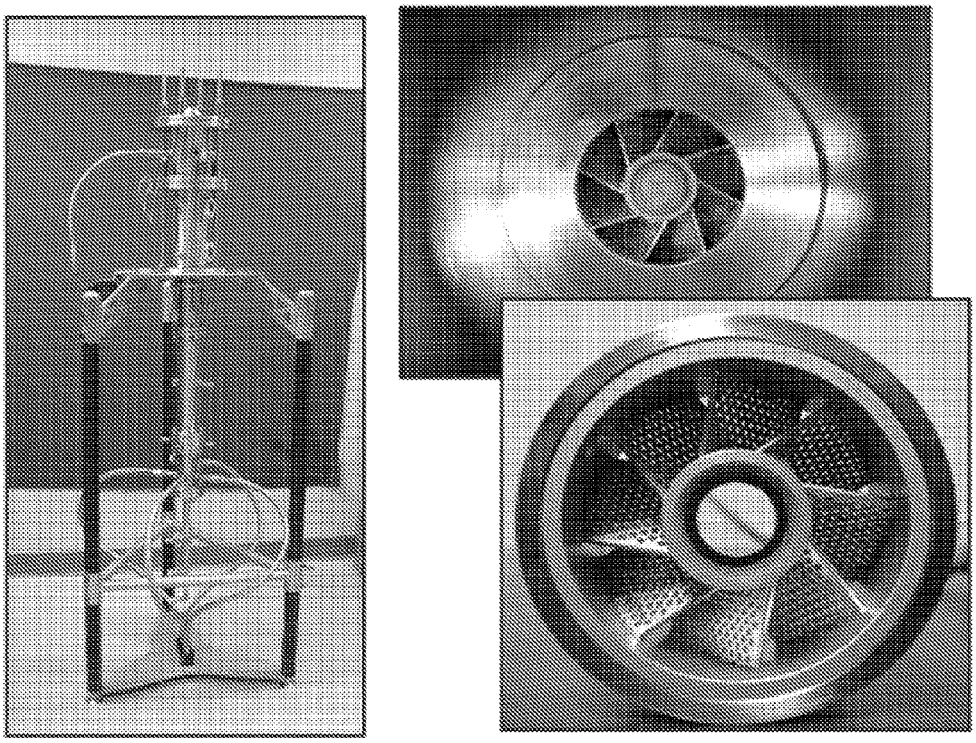
FIG. 14 depicts one embodiment of a combustion chamber design.
Figure 15:
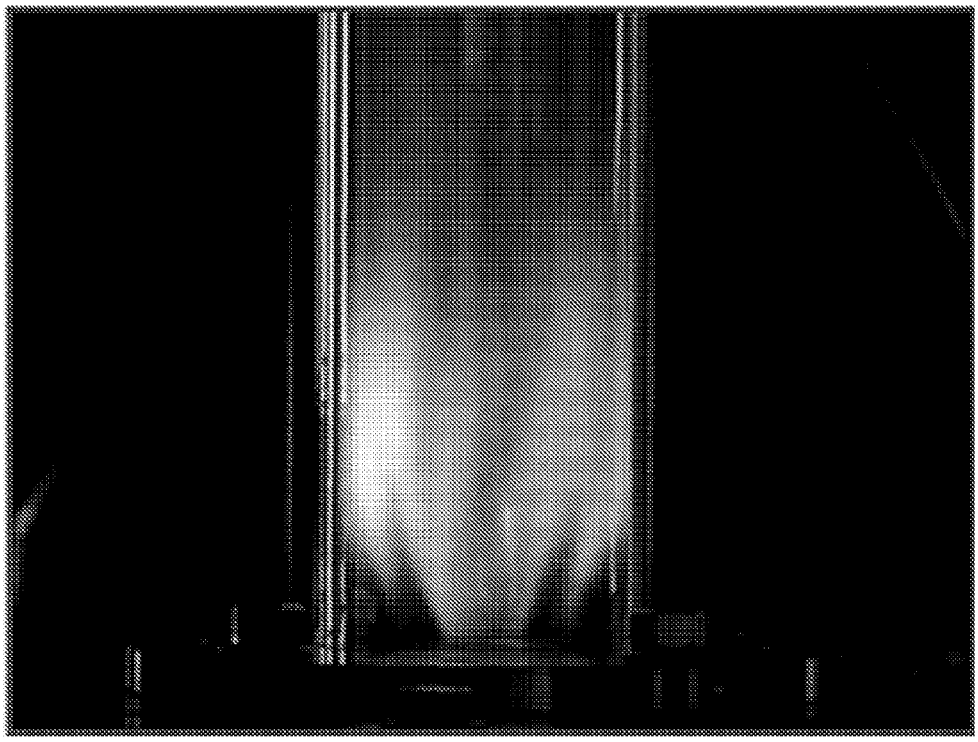
FIG. 15 depicts test parameters that were varied in preliminary testing of a prototype embodiment.

FIGS. 11A and 11B shows the rms of the pressure and heat release oscillations integrated over the entire range of frequencies. It is immediately clear that the case with the highest oscillations are associated with the solid swirlers (SS-S-L-0.5 has the highest oscillation levels) and the case with the lowest oscillations are the new MFIS injection device. The MM-S-L-1.5 case exhibits low oscillation, low noise characteristic over the entire operating range. Clearly, the MFIS injectors provide considerably superior performance from the perspective of combustion noise and dynamics.

SUMMARY

A new MFIS design for a fuel-air nozzle has been developed and fabricated. This new nozzle is shown to exhibit the following improvements over traditional solid-swirlers with a premixing length designs:

- Lower Lean Blow Out (LBO) limits with the MFIS nozzle. This extends the range of equivalence ratio operation. Lower LBO with the MFIS allows the combustor to run leaner which lowers NO production.
- For the same fuel loading (equivalence ratio), the MFIS nozzle produces higher heat release and firing temperature closer to the dump plane and has a more compact flame volume. This implies more efficient mixing with the MFIS technology, and the potential for reducing combustor volume and size over solid-swirler designs.
- The MFIS design inherently has a smaller premixing section and volume than the traditional solid swirler design that require longer premixing lengths for mixing. Thus, the MFIS design reduces the hardware size and volume (weight).
- For the same average flame temperature (or total heat release or adiabatic flame temperature), NOx levels are lower for the MFIS injectors. As an example at 1500K, NOx levels are nearly 40% lower with the MFIS injector compared to a solid swirler with upstream fuel injection.
- The MFIS injector design produces considerably less combustion noise over the operating regime from lean to stoichiometric than the solid swirler system. Thus, from a combustion noise perspective, the MFIS injector shows considerably improved performance.

The complete disclosures of all cited references are hereby incorporated by reference. Also incorporated by reference are the complete disclosures of the priority application, provisional application Ser. No. 61/088,151, filed Aug. 12, 2008; and of provisional application Ser. No. 60/913,473, filed Apr. 23, 2007; and of published international application WO/2008/131432, published Oct. 30, 2008. In the event of an otherwise irreconcilable conflict, however, the present specification shall control.

What is claimed:

1. Apparatus for the highly efficient mixing of gaseous fuel and air prior to combustion; said apparatus comprising a swirler having a plurality of blades, each blade having internal conduits that direct fuel through the interior of the blade to through holes on the surface of the blade; so that, in operation, fuel is injected into the air stream directly from the surface of the blades in a direction that is perpendicular or approximately perpendicular to the surface of the blades, and that is opposite or approximately opposite in direction to the oncoming air stream; as air enters the swirler, at least some of the air is swirled by the blades; the swirled air encounters injected fuel in a cross-flow direction, inducing eddies of air and fuel that enhance mixing and that enhance flame stability when the air-fuel mixture is burned.

* * * * *